US005593077A

United States Patent [19]

Izzo

[11] Patent Number: 5,593,077

[45] Date of Patent: Jan. 14, 1997

[54] SHOULDER-BORNE CARRYING STRAP ASSEMBLY FOR ARTICLES, SUCH AS, GOLF BAGS

[75] Inventor: Theodore-James Izzo, Evergreen, Colo.

[73] Assignee: Izzo Systems, Inc., Lakewood, Colo.

[21] Appl. No.: 482,320

[22] Filed: Jun. 6, 1995

Related U.S. Application Data

[63] Continuation of Ser. No. 185,760, Jan. 24, 1994, abandoned, which is a continuation of Ser. No. 967,784, Oct. 29, 1992, abandoned.

[51] Int. Cl.[6] ..... A45F 3/14

[52] U.S. Cl. ..... 224/627; 224/580

[58] Field of Search ..... 224/209, 202, 224/259, 917, 151, 580, 627; 206/315.3

[56] References Cited

U.S. PATENT DOCUMENTS

| | | | |
|---|---|---|---|
| 2,853,111 | 9/1958 | Williams | 224/259 |
| 4,182,470 | 1/1980 | Atkinson | 206/315.3 X |
| 4,487,347 | 12/1984 | Zegar | 224/259 |
| 5,038,984 | 8/1991 | Izzo | 224/209 |
| 5,348,205 | 9/1994 | Steurer | 224/209 |

*Primary Examiner*—Renee S. Luebke
*Attorney, Agent, or Firm*—John E. Reilly

[57] ABSTRACT

In a shoulder strap assembly for a golf bag, a first shoulder strap extends longitudinally between spaced locations on the outer surface of the bag and a second shoulder strap has opposite connecting ends which are connected in close proximity to one another to the bag adjacent to one of the spaced locations to which the first shoulder strap member is connected and in such a way that the second shoulder strap will extend away from the bag in a generally loop-shaped configuration whereby the bag may be suspended by one or both shoulder straps from one or both shoulders of the golfer or caddy.

19 Claims, 2 Drawing Sheets

SHOULDER-BORNE CARRYING STRAP ASSEMBLY FOR ARTICLES, SUCH AS, GOLF BAGS

CROSS-REFERENCE TO RELATED APPLICATIONS

This application is a file wrapper continuation application of Ser. No. 185,760, filed 24 Jan., 1994, for SHOULDER-BORNE CARRYING STRAP ASSEMBLY FOR ARTICLES, SUCH AS, GOLF BAGS, invented by Theodore-James Izzo, which is a continuation of Ser. No. 967,784, filed Oct. 29, 1992, both now abandoned.

This invention relates to shoulder straps for golf bags and the like; and more particularly relates to a novel and improved shoulder strap assembly for articles, such as, golf bags, luggage and backpacks which is highly efficient and comfortable in use.

BACKGROUND AND FIELD OF INVENTION

I have previously devised a golf bag carrying system which comprises a dual strap assembly including a first strap extending between the upper open end of the bag and handle, and a second strap extending from the handle to a lower location on the bag so that the golf bag can be suspended from and supported by both shoulders by placing a strap over each shoulder with the golf bag extending transversely across the back. My system as devised can be manufactured along with the bag as original equipment or retrofit to the standard golf bag by replacement of the existing strap. There is a need for a shoulder strap carrying system in which the existing strap on the bag can be replaced with a dual strap system; or the existing strap may serve as the first strap, and a second strap can be added to the bag with little or no modification of the existing strap so as to facilitate suspension of the bag from one or both shoulders. This approach enables retrofitting of the second strap virtually onto any size or style of golf bag without alteration of the bag itself and has particular utility in conjunction with the larger "pro" style or tour golf bags. On the professional golf tour, the golf bags are customarily provided with a single, heavy duty strap which extends from the upper open end of the bag to a location below the handle so that the entire weight must be suspended from one shoulder and therefore the weight of the bag is offset with respect to the spine and can lead to undue muscular strain on the back and pelvic region when carried for great distances by the caddy. Yet, there are numerous occasions when it is necessary to suspend the bag from one shoulder, for example, when the caddy must carry the bag through crowds or through close quarters and in carrying the bag for short distances.

It is therefore proposed to provide a shoulder-borne carrying system for golf bags and the like which is specifically adaptable for use both as a retrofit system for the larger "pro" style tour bags as well as for lighter bags and in such a way that the bag can be interchangeably suspended from one or both shoulders as circumstances dictate. Further, it is proposed to provide a system of the type described which is readily conformable for use with any type or style of bag with little or no modification of the bag itself.

SUMMARY OF THE INVENTION

Accordingly, it is an object of the present invention to provide for a novel and improved shoulder-borne carrying system for articles, such as, golf bags, luggage, backpacks and the like which will enable suspension of the article from either or both shoulders in a reliable and highly effective manner.

It is a further object of the present invention to provide for a novel and improved shoulder-borne carrying device for golf bags and the like which is of low cost, simplified manufacture and can be rapidly assembled onto existing golf bags or other articles without alteration of the bag or existing strap on the bag.

Yet another objective of the present invention is to provide for a novel and improved accessory strap for golf bags which will enable suspension of the bag across one or both shoulders and when suspended from both shoulders will enable the weight of the golf bag to be uniformly distributed across the back of the wearer.

It is a still further object of the present invention to provide for a novel and improved dual strap carrying system for golf bags which is specifically adaptable for use with the larger "pro" style tour bags to enable transfer of the bag between one or both shoulders when desired or necessary to shift the weight or orientation of the bag.

An additional object of the present invention is to provide an auxiliary shoulder strap which can be quickly but securely fastened to an existing golf bag to serve as the second strap of a dual strap carrying system so as to enable balanced weight distribution of the bag across the back of the wearer and increased comfort for the wearer in carrying the golf bag over extended distances.

In accordance with the present invention, in a golf bag having an elongated enclosure, a closed end, an opposite open end and a shoulder strap extending in a generally longitudinal direction between spaced locations along an outer surface of the enclosure whereby golf clubs may be placed in the golf bag and the golf bag carried by placing the strap over one shoulder of a person, the improvement comprising a second shoulder strap member having opposite connecting ends, and means for connecting the connecting ends to the golf bag for extension of the second shoulder strap in a generally loop-shaped configuration from the golf bag over another shoulder of the person whereby the golf bag may be suspended from one or both shoulders of the person. The connecting ends are connected to the golf bag enclosure or first strap or combination of same in closer proximity to one another than the spaced locations for the first shoulder strap and nearer to the closed end than to the open end of the enclosure.

In a preferred form of invention designed for use with the larger professional tour bags, the connecting ends of the second strap member are connected to the lower end of the first shoulder strap and in closely spaced relation to one another, and the connecting means are defined by longitudinally spaced ring members on the first shoulder strap through which the connecting ends are passed and slidably connected to the ring members.

In a modified form, the second shoulder strap member has connecting ends connected by means of common connection means to the attachment location for the lower end of the existing strap member on a conventional golf bag or to the sidewall of the golf bag and is specifically designed for use with the lighter carry bags but is readily conformable for use with the larger tour bags as well. Conversely, the second shoulder strap member of the preferred form is readily conformable for use with the lightweight carry bags. In general, the second shoulder strap member of either form is adaptable for use as a part of a dual strap assembly to replace the existing strap on a bag or may be added to the bag for use in combination with the existing strap on the bag.

Other objects, advantages and features of the present invention will become more readily appreciated and understood when taken together with the following detailed description in conjunction with the accompanying drawings, in which:

DETAILED DESCRIPTION OF THE PREFERRED EMBODIMENT

Figure 1:
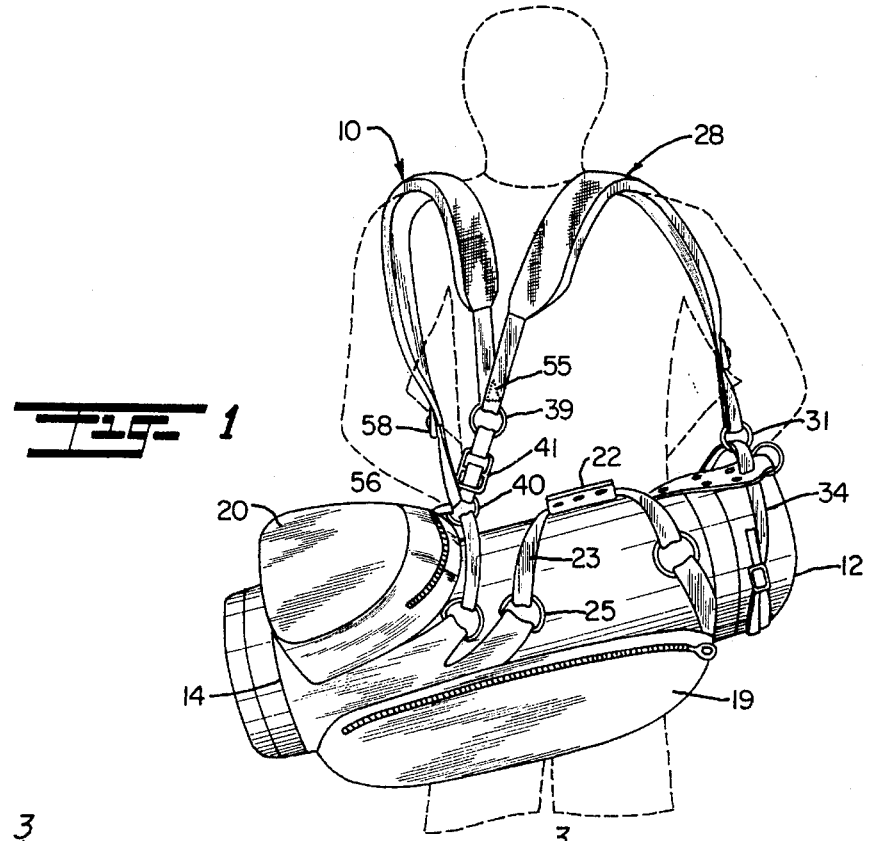
FIG. 1 is a rear view in perspective of a preferred form of golf bag illustrated in a suspended position from both shoulders of a golfer or caddy.
Figure 2:
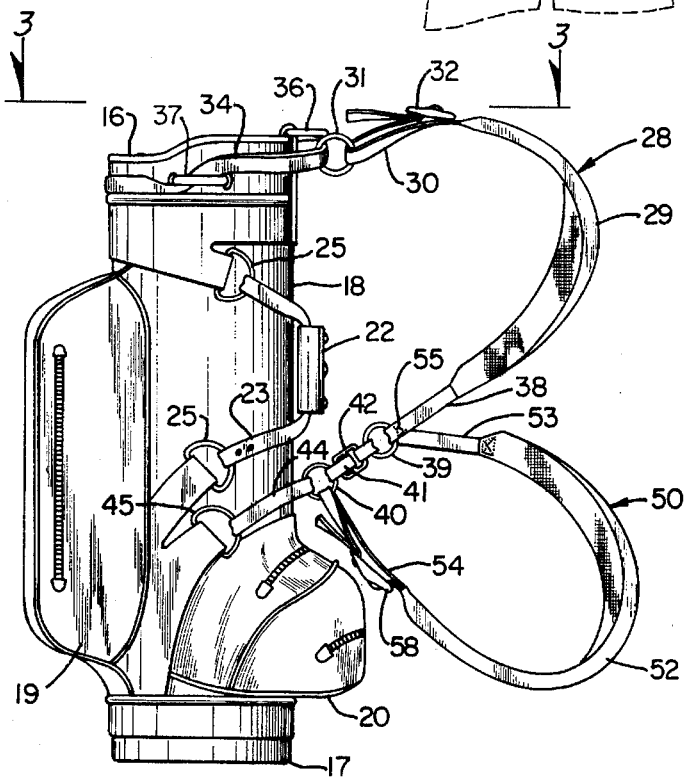
FIG. 2 is a side view in elevation of the preferred form of invention shown in FIG. 1.
Figure 3:
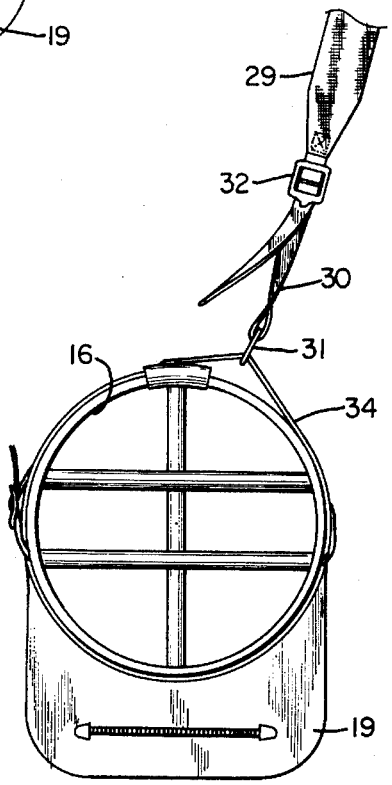
FIG. 3 is a top plan view of the golf bag illustrated in FIG. 3 and taken about lines 3—3 of FIG. 2.

Referring in more detail to the drawings, there is shown in FIGS. 1 to 3 a preferred form of shoulder strap assembly generally designated at 10 for a conventional golf bag 12. As a setting for the present invention, the strap assembly 10 will be described specifically in relation to its use in association with a tour bag 12 customarily used by golf professionals and which is larger and heavier than conventional golf bags, particularly the lighter weight carry bags which are so popular among amateurs who prefer to walk and carry their own bags in play. The golf bag 12 is broadly comprised of an elongated tubular enclosure 14 having an open end 16, closed end 17 and outer surrounding sidewall 18. A large compartment 19 is provided along one external portion of the sidewall 18 and a smaller compartment 20 is disposed toward the lower closed end of the enclosure diametrically opposite to the compartment 19. A handle or grip 22 is secured to the sidewall 14 by webbing 23 converging from D-rings 25 which are attached to spaced locations on the sidewall as shown.

In a preferred form of strap assembly 10, a strap member 28 includes an elongated, intermediate padded section 29 having an upper webbing strip 30 looped through a connecting ring 31 and adjustably secured by buckle 32. The ring 31 is slidably disposed on a rotator strap 34 at the upper open end 16 which extends circumferentially around the upper end 16 and passes between the sidewall 18 and a reinforcing strip 37. In this way, the strap 28 is free to advance or slide circumferentially along a quadrant of the bag from a point just past the attachment axis to a point approximately 90° removed in order to best distribute the weight of the bag against the back of the golfer or caddy C very much in accordance with my U.S. Pat. No. 5,042,703. This takes the place of the fixed attachment of a conventional strap, not shown, which is customarily done by securing its upper end to a standard mounting ring 36 which is held in the strip 37 at the upper edge of the open end 16.

A webbing strip 38 at the lower end of the padded section 29 is secured to a first connecting ring 39, and a second connecting ring 40 spaced from the first ring 39 by an interconnecting adjustable strap member 41 having a buckle 42. The endmost connecting ring 40 is in turn slidably secured to a webbing strip 44 which extends between circumferentially spaced attachment points defined by D-rings 45 around the exterior of the bag directly above the lower compartment 20 and beneath the handle 22.

The shoulder strap 28 forms a part of the strap assembly 10 in combination with a novel and improved form of shoulder strap 50 which is so constructed and arranged as to enable suspension of the bag from both shoulders. For this purpose, the strap 50 comprises an elongated intermediate padded section 52 which extends the greater length of the strap 50 and has opposite connecting ends in the form of webbing strips 53 and 54. The upper webbing strip 53 forms a continuation of the strip 38 and is looped around the connecting ring 39 and seamed as at 55 to the end of the webbing strip 38 with the connecting ring 39 extending through the limited opening formed between the common looped end and the webbing strips 38 and 53. The lower connecting end or strip 54 is looped through the ring 40 with a free end 56 passing through a buckle 58, the latter being of a conventional type which will permit adjustment in length of the strap member 50. In the preferred form as described, the rings 39 and 40 define closely spaced connecting means for securing the connecting ends 53 and 54 in closely spaced relation to the first shoulder strap 28 for extension of the second or auxiliary shoulder strap 50 in a generally loop-shaped configuration away from its connection via webbing strip 44 to circumferentially spaced points, defined by D-rings 45, on the bag, as shown in FIGS. 1 and 2.

Seaming together of the strips 38 and 53 in a generally triangular configuration as illustrated at 55 in FIGS. 1 and 2 serves to stiffen the connecting point between the strips so that the strip 53 will diverge away from the strip 38 and enable the golfer or caddy to more easily grasp or insert his or her arm through the strap either when the bag is resting on the ground or extending across the back.

As illustrated in my hereinbefore referred to U.S. Pat. No. 5,042,703, each of the flexible padded sections 29 and 52 is of curvilinear configuration in which the central axis of each padded section extends along a gradual curve; and when unassembled and disposed in a flattened condition will diverge away from their common connection to the ring 39. Accordingly, when assembled onto the bag as illustrated, the straps will better conform to the curvature of the shoulder and evenly distribute the weight of the bag between the shoulders. In addition, the inner shoulder-engaging surface of the padded section 29 is preferably composed of a non-slip surface; whereas the inner surface of the padded section 52 is composed of a slippery surface so that the second strap may be more easily slipped on and off the shoulder than the first strap 28, as disclosed in my hereinbefore referred to U.S. Pat. No. 5,042,703. This is of particular importance with the more tightly looped configuration of the second strap and the desirability of frequently removing the second strap from the shoulder when it is necessary to pass through crowds or other close quarters and the bag must be shifted closer to the body.

DETAILED DESCRIPTION OF MODIFIED FORM OF INVENTION

Figure 4:
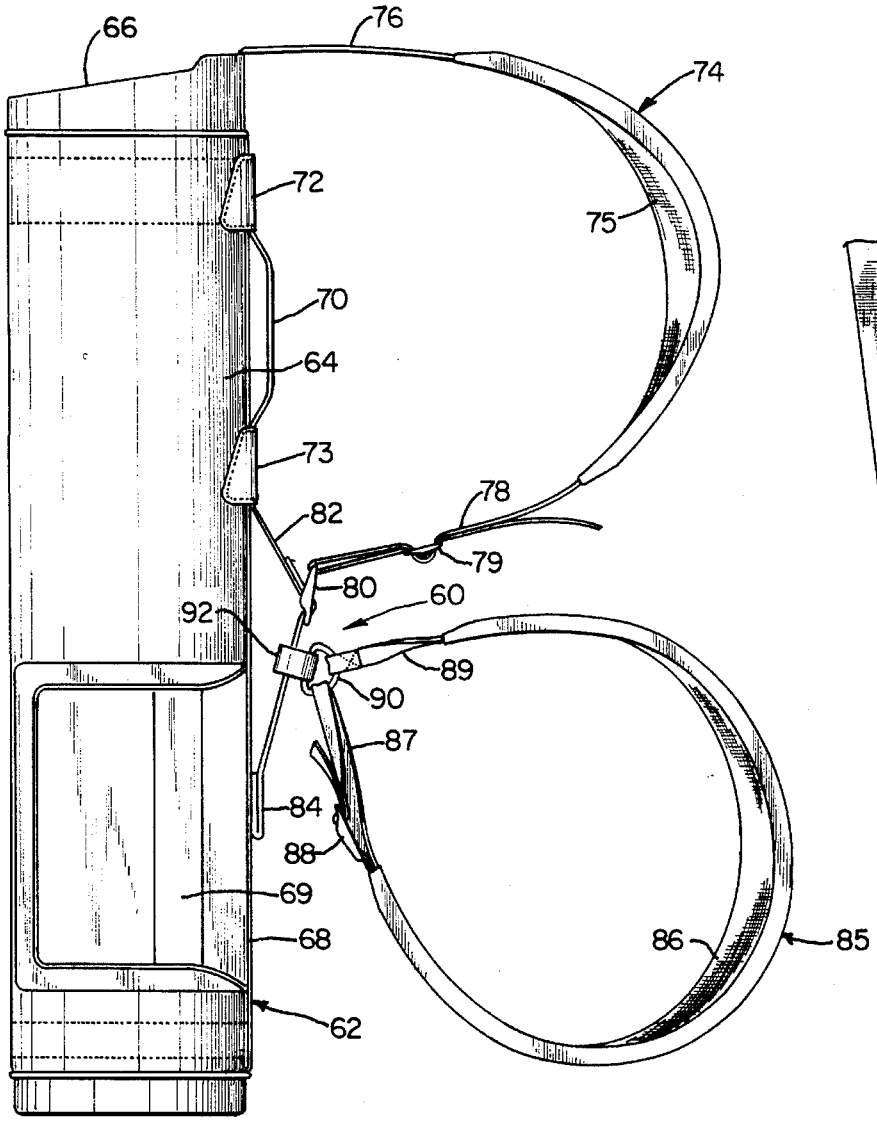
FIG. 4 is a side view of a modified form of strap assembly in accordance with the present invention.
Figure 5:
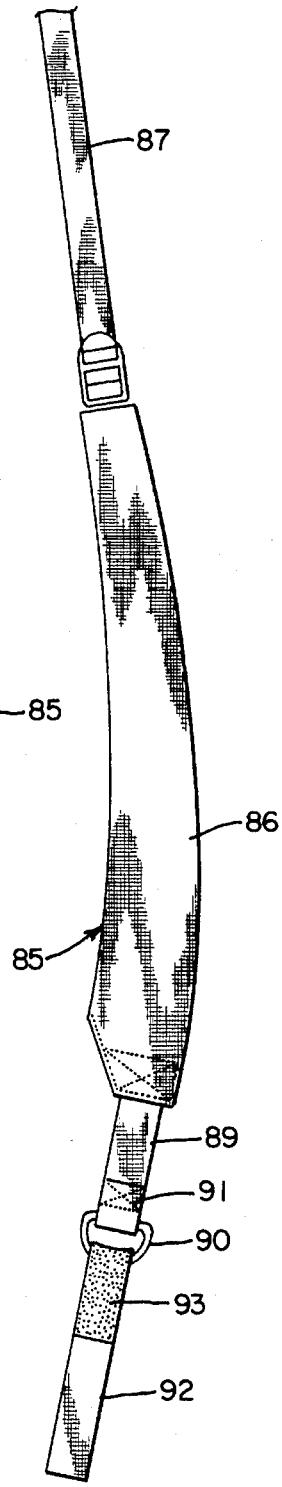
FIG. 5 is a top plan view of a preferred form of strap member in accordance with the present invention shown in a flattened unassembled position.

FIGS. 4 and 5 illustrate a modified form of invention in which a strap assembly 60 is modified for use with a conventional form of light-weight carry bag as designated at 62. For the purpose of illustration, the carry bag 62 basically corresponds to the standard "PING®" carry bag manufactured and sold by Karsten Manufacturing of Phoenix, Ariz., having an elongated tubular enclosure 64 with an upper open end 66, closed end 67 and outer surrounding sidewall 68. One or more compartments, such as, the compartment 69 is provided on the sidewall 68, and a standard handle or grip 70 is affixed at opposite ends by reinforcement members 72 and 73 along the attachment axis of the enclosure adjacent to the upper open end 66. A conventional strap member 74 supplied as a part of the "PING®" bag includes an intermediate padded section 75 extending the greater length of the strap member 74 with an upper webbing strip 76 attached to the upper open end of the bag and a lower webbing strip 78 which is looped through one end of a buckle 80 and threaded through a second buckle 79 for length adjustment of the strip 78. The buckle 80 is slidably secured to a webbing strip 82 which is affixed at its upper end to the reinforcement 73 and at its lower end 84 is affixed directly to the sidewall 68 along the attachment axis beneath the handle 70, the webbing strip 82 serving as the attachment location for the lower end of the strap member 74. In a well-known manner, the buckle 79 is adjustable with respect to the webbing 82 for proper balancing of the bag on one shoulder when the bag is filled with golf clubs, not shown.

In accordance with the present invention, a second or auxiliary shoulder strap 85 includes an elongated intermediate padded section 86 which extends the greater length of the strap 85 and has a webbing strip 87 at one end provided with a buckle 88 and a webbing strip 89 at the opposite end looped around a D-ring 90 and threaded upon itself as at 91. Another flexible webbing strip 92 includes a looped end 93 in surrounding relation to the D-ring 90, the end 93 having complementary Velcro® or hook-and-loop fastener portions which enable the strip 92 to be wrapped around and tightly affixed to the webbing strip 82 at the desired location for optimum weight distribution of the bag.

In the modified form, D-ring 90 serves as a common point of connection of the connecting ends 87 and 89 to the golf bag for extension of the padded section 86 away from the bag in a generally looped-shaped or circular configuration. The connection point is established by means of the Velcro® end 93 below the point of connection of the strap 74 to the webbing strip 82 and may be suitably varied along the length of the bag for optimum weight distribution and comfort to the golfer. Again, the strap 84 is given a curvilinear configuration, or slight curvature in the plane of the padded section 86, so as to best conform to the shoulder. For instance, the curvilinear configuration as illustrated in FIG. 5 is for a right-handed golfer in which the first or upper strap 74 is placed over the right shoulder and the second or lower strap 84 is placed over the left shoulder; and the curvilinear configuration may be reversed for a golfer who would wish to place the lower strap over the right shoulder.

It will be appreciated that the strap assembly 10 of the preferred form of FIGS. 1 to 3 is readily conformable for use with lightweight carry bags of the type illustrated in FIG. 4 by removal of the existing strap 74 and retrofitting the connecting ends 53 and 54 to the connection points on the bag 62 as described. Similarly, the strap 85 of the modified form of FIGS. 4 and 5 can be utilized in combination with an existing strap on the larger tour bags of the type described in connection with FIGS. 1 to 3. In this relation, the connecting ends 87 and 89 may be connected to a common point or to spaced points on the bag 12 including a first or existing shoulder strap on the bag and preferably in close proximity to or at the attachment location of the lower end of the first shoulder strap to the sidewall of the bag.

It is therefore to be understood that while preferred and modified forms of the invention have been herein set forth and described, the above and other modifications and changes may be made therein without departing from the spirit and scope of the present invention and defined by the appended claims and reasonable equivalents thereof.

I claim:

1. In a golf bag having an elongated enclosure, a closed end, an opposite open end, a handle on said enclosure between said open end and said closed end, and a first shoulder strap of open loop configuration extending in a generally longitudinal direction between spaced attachment points along an outer surface of said enclosure, one of said attachment points disposed adjacent to said open end and another of said attachment points longitudinally spaced from said one attachment point with said handle disposed between said attachment points whereby golf clubs may be placed in said golf bag and said golf bag carried by passing said strap over one shoulder of a person, the improvement comprising:

a second elongated shoulder strap member having opposite connecting ends, and attaching means for attaching both of said connecting ends closer to said other attachment point of said first shoulder strap than to said handle for extension of said second shoulder strap over another shoulder of the person whereby said golf bag may be suspended by said first shoulder strap from said one shoulder or by said first and second shoulder straps for balanced load distribution from both shoulders of the person.

2. In a golf bag according to claim 1, said connecting ends being connected nearer to said closed end than to said open end of said enclosure.

3. In a golf bag according to claim 1, said connecting ends being connected to said first shoulder strap.

4. In a golf bag according to claim 3, said connecting ends being connected to said first shoulder strap at said other attachment point.

5. In a golf bag according to claim 4, said second shoulder strap including a length-adjustable strap portion.

6. In a golf bag according to claim 5, said second shoulder strap member including an elongated padded member of curvilinear configuration, said connecting ends including flexible webbing strips at opposite ends of said padded member, and said attaching means including longitudinally spaced ring members on said first shoulder strap through which said webbing strips are passed and slidably connected to said ring members.

7. In a golf bag having an elongated enclosure, a closed end, an open end, a handle on said enclosure between said open end and said closed end, a first shoulder strap extending in a generally longitudinal direction, and first securing means for securing said first shoulder strap at longitudinally spaced locations with respect to said enclosure including a first location adjacent to said open end and a second location spaced from said open end with said handle disposed between said attachment points whereby golf clubs may be placed in said bag and said bag carried by passing said first shoulder strap over one shoulder of a person, the improvement comprising:

a second shoulder strap member having an intermediate, elongated flexible padded member, opposite connecting ends extending from opposite ends of said padded member, and second securing means for connecting both of said connecting ends substantially at said second location of said first shoulder strap for extension of said second shoulder strap member from said bag over another shoulder of the person whereby said golf bag may be suspended from one or both shoulders of the person.

8. In a golf bag according to claim 7, wherein circumferentially extending strap members are disposed at said first and second locations, and said first shoulder strap being slidably connected to said circumferentially extending strap members.

9. In a golf bag according to claim 7, said padded member being of curvilinear configuration, said connecting ends having flexible webbing strips at opposite ends of said padded member, said second securing means including longitudinally spaced ring members on said first shoulder strap through which said webbing strips are passed and slidably secured to said ring members.

10. A dual strap assembly for suspension of a shoulder-borne article from one or both shoulders of a person, the strap assembly comprising:

a first shoulder strap member having a first pair of connecting ends at opposite ends of said strap member and securing means for securing said first pair of connecting ends to spaced locations on said article, said securing means including spaced ring members on one connecting end of said first pair of connecting ends; and a second shoulder strap member having a second pair of connecting ends at opposite ends of said second shoulder strap member, each connecting end of said second pair of connecting ends including flexible webbing strips slidably connected to each of said ring members, and common attachment means for securing said second pair of connecting ends in proximity to said one connecting end of said first pair of connecting ends whereby said article may be carried by passing said first strap member over said one shoulder of the person or by passing said first and second strap members over both shoulders of a person.

11. A dual strap assembly according to claim 10, each of said first and second shoulder strap members including elongated flexible padded members.

12. A dual strap assembly according to claim 10, said securing means including a length-adjustable strap extending between said ring members.

13. A golf bag comprising in combination:

an elongated enclosure having a closed end, an opposite open end, a handle on said enclosure between said open end and said closed end, and a first shoulder strap of open loop configuration extending in a generally longitudinal direction between spaced attachment locations along an outer surface of said enclosure, one of said attachment locations disposed adjacent to said open end and another of said attachment locations longitudinally spaced from said one attachment location with said handle disposed between said attachment locations whereby golf clubs may be placed in said golf bag and said golf bag carried by passing said strap over one shoulder of a person;

a second elongated shoulder strap; and connecting means for connecting said second shoulder strap at circumferentially spaced points on said enclosure substantially at said other of said attachment locations of said first shoulder strap whereby said golf bag may be suspended by said first shoulder strap from said one shoulder or by said first and second shoulder straps for balanced load distribution from both shoulders of the person.

14. A golf bag according to claim 13, said second elongated shoulder strap having opposite connecting ends connected in close proximity to one another at said other of said attachment locations.

15. A golf bag according to claim 13, wherein said connecting means includes a connecting strap extending between said circumferentially spaced points, and said second elongated shoulder strap being slidably connected to said connecting strap.

16. A golf bag according to claim 15, said first shoulder strap being slidably connected to said connecting strap.

17. A golf bag comprising in combination:

an elongated enclosure having a closed end, an opposite open end, a handle on said enclosure between said open end and said closed end, and a first shoulder strap of open loop configuration extending in a generally longitudinal direction between spaced attachment locations along an outer surface of said enclosure, one of said attachment locations disposed adjacent to said open end and another of said attachment locations longitudinally spaced from said one attachment location with said handle disposed between said attachment locations whereby golf clubs may be placed in said golf bag and said golf bag carried by passing said strap over one shoulder of a person; and a second shoulder strap member having opposite connecting ends, and attaching means for connecting said opposite connecting ends to said other of said attachment locations of said first shoulder strap.

18. A golf bag according to claim 17, said attaching means including a common connecting ring member and a hook and loop fastener loop disposed in surrounding relation to said other of said attachment locations.

19. A golf bag according to claim 17, said other of said attachment locations including a longitudinally extending strap attached to a lower end of said golf bag.

* * * * *